United States Patent [19]

Nilson

[11] Patent Number: 4,826,027

[45] Date of Patent: May 2, 1989

[54] SEAL

[75] Inventor: Nils B. Nilson, Mjölby, Sweden

[73] Assignee: Tally Safe Systems AB, Sweden

[21] Appl. No.: 166,785

[22] Filed: Mar. 2, 1988

Related U.S. Application Data

[63] Continuation of Ser. No. 929,293, Oct. 2, 1986, abandoned.

[30] Foreign Application Priority Data

Feb. 28, 1985 [SE] Sweden ..... 8500993

[51] Int. Cl.[4] ..... B65D 27/30; B65D 33/34; B65D 55/06

[52] U.S. Cl. ..... 215/230; 116/200; 116/212; 292/307 R

[58] Field of Search ..... 116/200, 212, 214; 137/384; 292/307 R; 215/230, 265, 266; 206/221

[56] References Cited

U.S. PATENT DOCUMENTS 4,410,085 10/1983 Beneziat et al. ..... 206/221

FOREIGN PATENT DOCUMENTS 880558 10/1961 United Kingdom ..... 206/221

*Primary Examiner*—Stephen Marcus
*Assistant Examiner*—Nova Stucker
*Attorney, Agent, or Firm*—William A. Drucker

[57] ABSTRACT

A seal for container locks and the like comprises two units (1,2,3;8,14,15) which are snapped into each other. The snap action is carried out by means of a plug (14) forming part of one of the units (8,14,15) and which normally closes a cavity (13) containing an indicating means (21). When the parts are separated the plug is drawn out from this position and allows the indicating means to leave said cavity. In one embodiment the plug (14) is hollow and is closed by means of a steel pin (15) which when inserted has put the indicating means under pressure and the plug has blocking vanes (18). In another embodiment the plug is not hollow but has a weak lower portion and supports a resilient blocking ring. A steel pin floats in the cavity and can break the weak wall when an attempt to brake the seal is made.

9 Claims, 2 Drawing Sheets

SEAL

This application is a continuation of application Ser. No. 929,293, filed Oct. 2, 1986, now abandoned.

This invention refers to a seal.

Seals of different kinds are used to render it difficult for unauthorized persons to open a door, a lid or a similar kind of closure.

Particularly when containers which can contain items of considerable value are concerned, it is imperative that the seal not be breakable in a simple way and then restored so as to be able to pass an inspection.

The seals in common use generally comprise a strip member which at both ends is formed to locking members which when interengaged lock each other in a non-releasable manner. The strip member may be made from a thin metal sheet material or from plastic material but in both cases it is relatively easy to restore cut strips into a seemingly unopened condition by means of soldering, heating or the like.

Thus there have been considerable losses especially for the insurance companies due to unauthorized breaking of seals.

The main object of the invention thus has been to overcome this disadvantage of the known seals and to provide a seal which effectively indicates also an attempt to break it. In order to accomplish this and further objects the invention has the characteristics of the claims.

The accompanying drawing illustrates an exemplary embodiment of the invention wherein FIG. 1 is a section through a part of a container lock with attached seal according to a first embodiment of the invention.

Figure 2:
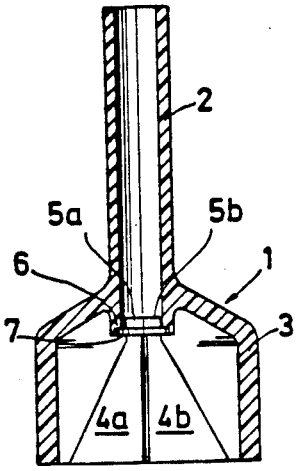
FIG. 2 is a longitudinal section through one of the two main parts of the seal.
Figure 3:
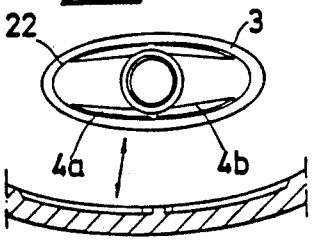
FIG. 3 shows the main part according to FIG. 2 seen from the under side and FIG. 4 is a longitudinal section through the second main part of the seal.

The seal illustrated in the drawing includes a first main part generally designated as 1 (see also FIG. 2) which is made from a translucent material, preferably transparent plastic. It comprises a tubular portion 2 which continues in a hollow head 3, which as seen in FIG. 3, preferably is elliptic in transverse section. The head comprises, for a purpose to be described hereinbelow substantially triangular recesses 4*a*, 4*b* with portions 5*a*, 5*b* which can be of rectangular shape and extend into a tubular extension 6 of the tubular portion 2. Said tubular extension 6 further has a bore 7 extending from the free end thereof.

The seal further includes a second main part which, like the main part 1 preferably is manufactured from plastic material but from an opaque or partly translucent material. This main part, generally designated 8, and shown in detail in FIG. 4 comprises, like the first main part, a tubular portion 9, which continues in a head 10, which preferably has an elliptic section. As appears from FIG. 4, there is provided in the transition between the tubular portion 9 and the head 10 provided an annular recess 11. In order to avoid an excessive wall thickness the head preferably has recesses 12.

Figure 4:
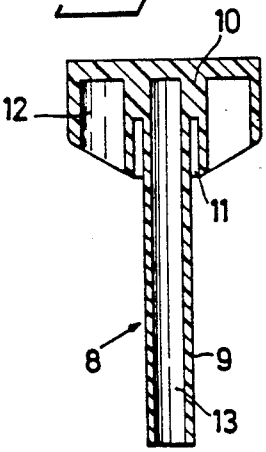
Figure 5:
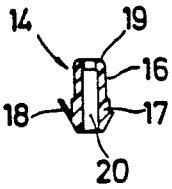
FIG. 5 is a longitudinal section through a plug connectable to the second main part and FIG. 6 shows a label for the seal in an extended position.

As appears from FIG. 4 the cavity 13 of the tubular portion 9 extend into the head and up to the vicinity of the upper side thereof.

Finally the seal includes a plug generally designated 14 and a pin 15 preferably of steel. The plug 14 is intended, together with the pin 15, to close the mouth of the tubular portion 9 and has for that purpose a cylindrical portion 16 which frictionally engages the mouth and a wider portion 17 from which a number (in the shown embodiment three) of resilient vanes 18 extend for a purpose to be described. The plug which preferably is made from a plastic material which can give a fluid tight closure, is however perforated by two holes 19, 20 from which the first mentioned hole is so calibrated relative to the diameter of the pin 15 that it may be closed in a watertight manner by means of said pin.

Figure 1:
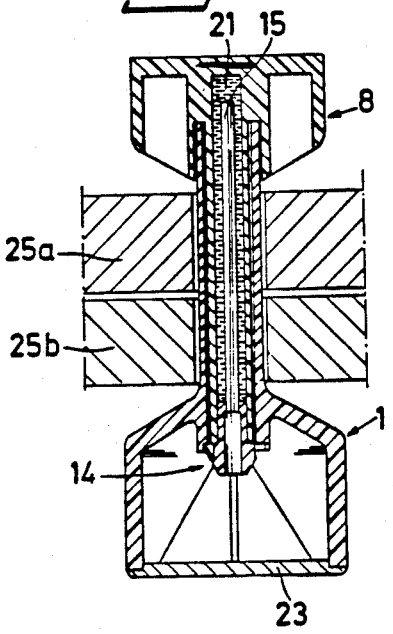

As appears from FIG. 1 the seal is provided to contain an indicating means 21 which can be of any suitable kind but in the illustrated example is a coloured liquid.

The parts 8, 14, 15 and the indicating means 21 are brought together to form of unit and this preferably is carried out by pouring a measured quantity of indication liquid into the cavity 13 whereupon the plug 14 is pressed into the mouth of the tubular portion 9.

Since the amount of liquid is so measured that it is accommodated in the cavity 13 even after the plug has been pressed into position, liquid will not be allowed to flow out through the holes 19, 20 of the plug. The amount of liquid is however such that the cavity 13 will be completely filled when the pin 15 is inserted and when the latter is fully inserted the liquid will be under a pre-determined pressure for a purpose to be described.

Figure 6:
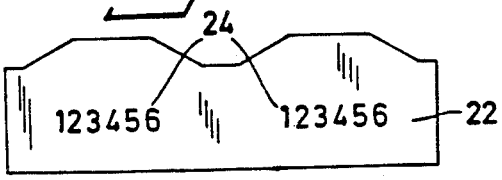

The main part 1 constitutes together with a label 22 shown in FIG. 6 and a cover 23 a second unit, provided to constitute together with the unit just described the new seal.

The label 22 consists of a strip made from a transparent plastic film or the like and has an indentifying symbol 24 printed at two places which in the operative position of the label will be opposite to each other.

The label is, according to FIG. 3, intended to contact the interior of the head 3 except for the portions where the recesses 4*a*, 4*b* are provided. Since the length of the label substantially corresponds to the circumference of the inner surface of the head it is evident that the symbol 24 will appear opposite to each other which means that the symbol in question will be visible from the front side and from the rear side. When the label has been applied in the manner described the cover 23 is applied for instance by glueing or welding.

The units just described are provided to be brought together when the seal is applied. This is accomplished by inserting the main part 1 with parts attached thereto up through the holes arranged for this purpose in two locking lugs 25*a*, 25*b* positioned one above the other and which constitute the so called container lock, whereupon the second main part 8 with parts attached thereto from the top is connected to the other main part. As the inner diameter of the tubular part 2 is little wider than the outer diameter of the tubular portion 9 the resilient vanes 18 during this operation will be pressed slightly inwardly such that by friction they may pass through the tubular part 2 to the extension thereof. When the vanes 18 pass the shoulder between the bore 7 and the cavity 2 of the tubular portion they will however spring out and contact said shoulder. In this position the upper end of the tubular part 2 has entered the annular bore and the seal is in its operating position.

An attempt to break the seal by pulling the two units out of each other will pull the plug 14 out of the tubular portion 9 due to the engagement of the vanes 18 with the shoulder between the bore 7 and the cavity of the part 2, which in turn causes indicating liquid to flow down into the hollow head 3 where it will be visible rapidly.

Owing to the triangular recesses 4a, 4b a strongly coloured triangle is immediately constituted. Also an incomplete attempt will thus be effectively unveiled.

Due to the fact that the bore 7 is so calibrated that the vanes when located therein will not be able to expand, the risk that the vanes are turned is prevented.

Also an attempt to break the seal by cutting off the narrow portion thereof above or below the lugs **25*a*, 25*b* will immediately be unveiled partly because of colour leakage takes place as soon as the saw blade or the like penetrates the tubular part 2 and partly and more accentuated when it has come into contact with the steel pin 15, as the latter when hit by the saw blade will be tilted and thus will permit coloured liquid to flow down into the marking triangle which the recesses 4*a*, 4*b*, 5*a*, 5*b* constitute via the holes 19, 20**. Additionally the steel pin prevents cutting from one single direction.

No possibility seems to exist to afterwards restore such a seal into a seemingly intact condition and consequently the seal will effectively prevent an unauthorized access to the container.

A theoretical possibility to break the seal would be to drill a hole through the head and then for instance suck out the liquid which however would need very extensive resources, skill and time to be realistic.

However, in order to render such a possibility and similar possiblities impossible, the head 10 may be provided with a molded-in steel plate, a steel pin or the like.

In the foregoing coloured liquid has been mentioned as an indicating means but it is also possible to use a liquid which when brought into contact with the material of the main part 1 will give an indicative effect as well as a liquid which in combination with for instance another in the main part 2 contained liquid will give the desired indication and of course gases, powders or the like also may be used for the purpose.

The relatively small axial extension of the bore 19 in the plug will make the tilting of the pin, which takes place when a cutting attempt is made, effective for bringing forth the desired leakage.

The fact that the liquid is under a certain pressure causes the indication to occur rapidly and effectively.

Figure 7:
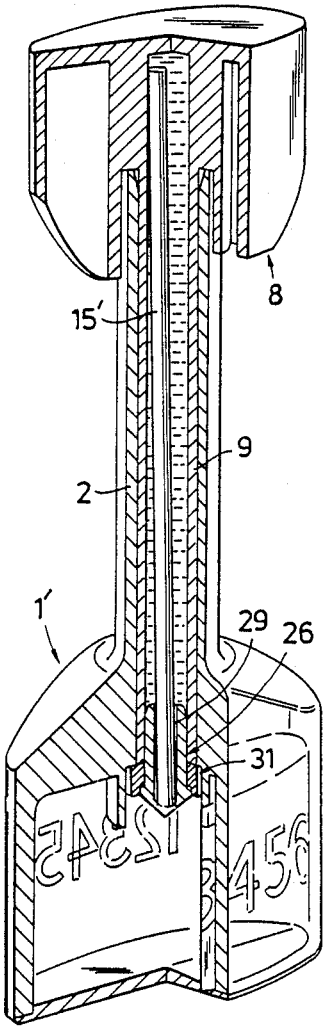
FIG. 7 shows in perspective and in a partly broken away manner a second embodiment of the invention whereas FIG. 8 in perspective shows two components forming part of the seal according to FIG. 7
Figure 8:
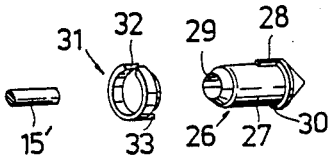
Figure 9:
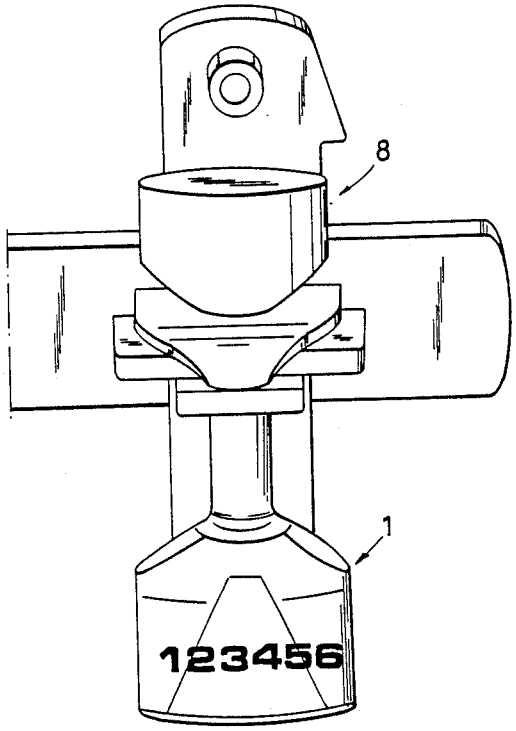
FIG. 9 shows a seal with corresponding parts of a container lock.

The seal illustrated in FIGS. 7–9 inclusive differs from the seal just described mainly that the steel pin 15' is floating in the cavity 21 of the main part 8, that the plug 14 is substituted by another construction and that the indicating liquid is introduced in another manner than the one just described.

As appears from FIG. 7 and FIG. 8 the plug 14 is in fact substituted by an end closure 26 which comprises a portion 27 which is sealingly insertable in the tubular portion 9 and which terminates in a flange from which extends an axial rib 28 limiting the insertion of the plug into the portion 9. The end closure has a hole 29 which does not extend entirely therethrough but as appears from FIG. 7 this hole is so shaped and calibrated that the lower end wall of the end closure will be very thin. In the flange portion thereof the end closure further has a recess 30 for a purpose to be explained.

A ring 31 made from resilient material is slotted at 32 and has a preferably oppositely positioned axially extending projection 33. The height of the ring is somewhat less than the axial extension of the rib 28 and the internal diameter thereof exceeds the outer diameter of the part 27 and it will thus be possible to thread the ring upon the end closure such that the projection 33 thereof will be received in the recess 30 at the same time as the slot 32 with clearance to receive the rib 28. As the slot 32 is considerably wider than the rib 28 the ring may, from the untensioned normal position thereof (position in which the outer diameter thereof exceeds the inner diameter of the tubular portion 2 of the main part 1) be compressed such that the outer diameter thereof will be the same as or less than the inner diameter of the tubular portion 2, which as appears from FIG. 7 lacks the bore 7 according to FIG. 2.

To assemble the seal now described the main part 8 is turned upside down and indicating liquid is poured into it. The steel pin is then dropped into the liquid at the same time as the end closure 26 with resilient ring 34 connected thereto closing the mouth of the tubular portion 9 while guiding the steel pin according to FIG. 7.

The main part 8 may then be connected to the main part 1 in the manner described and the resilient ring will then be compressed such that it can pass through the portion 9. As soon as it has passed the lower mouth of said portion it will however spring out and in a blocking manner, contact the lower edge of said portion.

The seal now described is safer than the seal according to FIG. 1 since the steel pin 15' need not sealingly penetrate the indicating liquid containing space and since the resilient ring 31 will give a much safer function than the resilient wings 18. The thin wall section in the lower portion of the end closure further results in a breakage of said wall when an attempt is made to break the seal. In other respects the function of the seal substantially corresponds to that previously described in connection with FIG. 1.

I claim:

1. A signalling seal for containers and the like, comprising:

two interengaged units, each unit having a tubular portion, one said tubular portion, in the assembled condition of the seal, fitting into the other said tubular portion with a predetermined radial clearance whereby said units, to be separated, have to be drawn out of each other, the inner one of the tubular portions having one end thereof closed and containing a predetermined amount of an indicating means, the opposite end thereof being closed by means of a plug which closes the mouth of the inner tubular portion and being in contact with the outer tubular portion, one of said tubular means having one of a shoulder constituted by the end of said tubular portion thereof or the bore of said tubular portion and a recess provided in the end of said tubular portion, said plug being responsive to separation of said units to leave the position in which it closes said inner tubular portion to cause said indicating means to leave the inner tubular portion, thereby allowing said indicating means to signal any unauthorized attempt to separate said units, said plug further having plural resilient, obliquely extending vanes which, when the units are interengaged, pass through the tubular portion of one of said units and, at the end of said interengaging action, spring out and contact one of said shoulder which is constituted by the end of said tubular portion or between said bore of said tubular portion and said recess provided in said end of said tubular portion.

2. Seal as claimed in claim 1 further including steel plates in said head of one of the units to prevent drilling through said head.

3. A signalling seal for containers and the like, comprising:

two interengaged units, each unit having a tubular portion, one said tubular portion, in the assembled condition of the seal, fitting into the other said tubular portion with a predetermined radial clearance whereby said units, to be separated, have to be drawn out of each other, the inner one of the tubular portions having one end thereof closed and containing a predetermined amount of an indicating means, the opposite end thereof being closed by means of a plug which closes the mouth of the inner tubular portion and being in contact with the outer tubular portion, one of said tubular means having one of a shoulder constituted by the end of said tubular portion thereof or the bore of said tubular portion and a recess provided in the end of said tubular portion, said plug being responsive to separation of said units to leave the position in which it closes said inner tubular portion to cause said indicating means to leave the inner tubular portion, thereby allowing said indicating means to signal any unauthorized attempt to separate said units, said plug further having a through bore having a pin extending therein which, when inserted, places said indicating means contained in one of the units under pressure and which extends to the vicinity of one end of the inner tube shaped portion.

4. Seal as claimed in claim 3 wherein each said unit includes a head and said tubular portion contains said indicating means in axial direction and extends into the head of the units.

5. Seal as claimed in claim 4 further including steel plates in said head of one of the units to prevent drilling through said head.

6. A signalling seal for containers and the like, comprising:

two interengaged units, each unit having a tubular portion, one said tubular portion, in the assembled condition of the seal, fitting into the other said tubular portion with a predetermined radial clearance whereby said units, to be separated, have to be drawn out of each other, the inner one of the tubular portions having one end thereof closed and containing a predetermined amount of an indicating means, the opposite end thereof being closed by means of a plug which closes the mouth of the inner tubular portion and being in contact with the outer tubular portion, one of said tubular means having one of a shoulder constituted by the end of said tubular portion thereof or the bore of said tubular portion and a recess provided in the end of said tubular portion, said plug being responsive to separation of said units to leave the position in which it closes said inner tubular portion to cause said indicating means to leave the inner tubular portion, thereby allowing said indicating means to signal any unauthorized attempt to separate said units, each unit having a head portion, said inner tubular portion extending into said head portion, said plug further including a label positioned in said head in contact with said corresponding inner surface thereof, recesses in said inner surface constituting a substantially capillary space in which the indicating means flows from said inner tubular portion when an attempt is made to break the seal, said indicating means thereby being visible outside the label and in direct contact with said head.

7. A signalling seal for containers and the like, comprising:

two interengaged units, each unit having a tubular portion, one said tubular portion, in the assembled condition of the seal, fitting into the other said tubular portion with a predetermined radial clearance whereby said units, to be separated, have to be drawn out of each other, the inner one of the tubular portions having one end thereof closed and containing a predetermined amount of an indicating means, the opposite end thereof being closed by means of a plug which closes the mouth of the inner tubular portion and being in contact with the outer tubular portion, one of said tubular means having one of a shoulder constituted by the end of said tubular portion thereof or the bore of said tubular portion and a recess provided in the end of said tubular portion, said plug being responsive to separation of said units to leave the position in which it closes said inner tubular portion to cause said indicating means to leave the inner tubular portion, thereby allowing said indicating means to signal any unauthorized attempt to separate said units, each unit having a head portion, said inner tubular portion extending into said head portion, further including steel plated in said head of one of said units to prevent drilling through said head.

8. A signalling seal for containers and the like, comprising:

two interengaged units, each unit having a tubular portion, one said tubular portion, in the assembled condition of the seal, fitting into the other said tubular portion with a predetermined radial clearance whereby said units, to be separated, have to be drawn out of each other, the inner one of the tubular portions having one end thereof closed and containing a predetermined amount of an indicating means, the opposite end thereof being closed by means of a plug which closes the mouth of the inner tubular portion and being in contact with the outer tubular portion, one of said tubular means having one of a shoulder constituted by the end of said tubular portion thereof or the bore of said tubular portion and a recess provided in the end of said tubular portion, said plug being responsive to separation of said units to leave the position in which it closes said inner tubular portion to cause said indicating means to leave the inner tubular portion, thereby allowing said indicating means to signal any unauthorized attempt to separate said units, each unit having a head portion, said inner tubular portion extending into said head portion, a slotted resilient ring, said plug comprising an end closure for closing said inner tubular portion and supporting with a slight axial clearance said resilient ring slotted such that it, in a compressed condition, together with said end closure, is displaced through said inner tubular portion and, when leaving the same, springs out to prevent said end closure from being displaced back up through said tubular portion.

9. Seal as claimed in claim 8, a ring, said inner tubular portion having an upper end wall and said end closure having a flange and a cavity, further including a steel pin, extending almost to said upper end wall of said inner tubular portion, and having its opposite end portion guided in said cavity of said end closure in that part having a wall which is easily penetrated and the end closure having an end flange and a rib axially extending therefrom and having a length exceeding the height of said ring and provided to limit the insertion of said end closure into the inner tubular portion, said ring having a slot having a width considerably exceeding the width of the rib such that the ring located between the end portion of the inner tubular portion and the flange of the end closure with the slot receiving the rib is compressible and respectively expanded, said ring and end closure having interengaging guide means to prevent rotation of said ring relative to the end closure.

* * * * *